US005624353A

United States Patent [19]

Naidus

[11] Patent Number: 5,624,353

[45] Date of Patent: Apr. 29, 1997

[54] DYNAMICALLY CONTROLLED RESISTANCE EXERCISE MACHINE

[76] Inventor: Scott G. Naidus, 30 Schoolhouse Rd., Amherst, N.H. 03031

[21] Appl. No.: 689,075

[22] Filed: Jul. 30, 1996

Related U.S. Application Data

[60] Provisional application No. 60/015,020, Apr. 8, 1996.

[51] Int. Cl.[6] ..... A63B 21/06; A63B 23/04

[52] U.S. Cl. ..... 482/5; 482/97; 482/137; 482/139; 482/1

[58] Field of Search ..... 482/5, 97, 100, 482/133, 136, 137, 138, 139

[56] References Cited

U.S. PATENT DOCUMENTS

| | | | |
|---|---|---|---|
| 956,264 | 4/1910 | Bailey | 482/97 |
| 4,231,568 | 11/1980 | Riley et al. . | |
| 4,407,496 | 10/1983 | Johnson | 482/139 |
| 4,509,746 | 4/1985 | Mask . | |
| 4,650,185 | 3/1987 | Cartwright | 482/97 |
| 5,088,726 | 2/1992 | Lapcevie . | |
| 5,286,243 | 2/1994 | Lapcevic | 482/97 |
| 5,344,374 | 9/1994 | Telle . | |
| 5,356,360 | 10/1994 | Johns . | |
| 5,387,170 | 2/1995 | Rawls et al. . | |

FOREIGN PATENT DOCUMENTS

| | | | |
|---|---|---|---|
| 3327235 | 2/1985 | Germany | 482/97 |

*Primary Examiner*—Richard J. Apley
*Assistant Examiner*—John Mulcahy
*Attorney, Agent, or Firm*—Richard C. Litman

[57] ABSTRACT

A weight training machine having a dynamically controlled resistance capability. The user exercises by causing an exercise arm to pivot. Pivoting coaxially with the exercise arm, is a pivot arm which supports a secondary weight. To pivot the exercise arm, the user must overcome a primary resistance and the torque on the pivot arm due to the secondary weight. The torque due to the secondary weight can be dynamically varied by varying the position of the secondary weight on the pivot arm. Thus the resistance experienced by the user, can be varied within a predetermined range. A force input mechanism engageable with a body part of the user is also disclosed which reduces discomfort to the user during exercise.

14 Claims, 9 Drawing Sheets

DYNAMICALLY CONTROLLED RESISTANCE EXERCISE MACHINE

CROSS-REFERENCE TO RELATED APPLICATIONS

This application claims the benefit of U.S. Provisional Patent Application Ser. No. 60/015,020 filed on Apr. 8, 1996.

BACKGROUND OF THE INVENTION

1. FIELD OF THE INVENTION

The present invention relates to an exercise machine in which the resistance experienced by a user can be varied dynamically under the control of the user or an instructor.

2. DESCRIPTION OF THE PRIOR ART

In weight training, exercises involve the movement of a body part subject to an externally applied resistance. The exercise itself is the movement of a body part through a predetermined range of motion, which is also referred to herein as the movement. To enhance muscular development an external force is applied to the body part during the execution of the movement. In other words, an external resistance must be overcome for the movement to be executed.

The exercise routine or exercise program is generally broken up into sets. Each set consists of executing several repetitions of the movement or exercise. A period of rest follows each set after which the subsequent set is performed. The number of repetitions in each set is determined by the limit of endurance of the person performing the exercise.

To maximize muscular development and strength gains, athletes perform what are known as forced repetitions. Near the end of the set, the muscles stored energy reserves become depleted, and as a result, the force generated by the muscle is reduced compared to a rested muscle. Therefore, the athlete may not be able to execute the movement after a certain number of repetitions. When an athlete reaches this point, he or she forces himself or herself to perform a few extra repetitions which cannot be performed without some assistance from another person referred to as a "spotter". These extra repetitions are known as "forced repetitions" and help to maximize muscular hypertrophy.

The problem with using a spotter is that the athlete has to schedule workouts at times that are convenient for both the athlete and the spotter. Therefore, the need for a spotter reduces the athlete's freedom and flexibility in scheduling the athlete's workouts, and can lead to a reduction in the athlete's opportunities to workout. The exercise machine of the present invention has been developed to obviate the need for a spotter and thus allow the athlete to work out whenever it is convenient for him or her. Further, the exercise machine of the present invention allows a coach or instructor to vary the resistance against which the athlete is working while observing the athlete during the performance of the exercise.

Although a dynamically variable resistance exercise machine is known in the prior art, none of the prior art show the electromechanical variation of the resistance by varying the moment arm of a weight moved along a pivoting arm under the impetus of an electric motor.

U.S. Pat. No. 4,231,568, issued to Robert Q. Riley et al. on Nov. 4, 1980, shows an exercise machine where the movement performed by the user is resisted by springs. The force exerted by the user is applied to the springs through a cam arrangement which ensures that constant force is applied by the user throughout the range of motion characteristic of the particular exercise. Riley et al. do not use an electric motor to move a weight along a pivoting arm.

U.S. Pat. No. 4,509,746, issued to Ernest D. Mask on Apr. 9, 1985, shows a leg exercise bench that converts from a first configuration to a second configuration. The first configuration allows the user to be in a seated posture and perform leg exercises that are normally performed in the seated posture. The second configuration allows the user to be in a prone posture and perform leg exercises that are normally performed in the prone posture. Mask does not use an electric motor to move a weight along a pivoting arm.

U.S. Pat. No. 5,088,726, issued to Thomas G. Lapcevie on Feb. 18, 1992, shows an exercise apparatus in which the user exercises by applying a torque to a cam. A cable attached to the cam is routed through several pulleys and supports a stack of weights. The user's performance of the exercise causes the cam to rotate, lifting the stack of weights via the cable. The resistance experienced by the exerciser during the execution of the exercise varies in accordance with the profile of the cam to which the cable pulling the stack of weights is attached. Therefore by choosing the cam profile, any desired variation in resistance during the execution of the exercise can be obtained. Lapcevie does not use an electric motor to move a weight along a pivoting arm.

U.S. Pat. No. 5,356,360, issued to George Johns on Oct. 18, 1994, shows a weight training machine with a variable resistance cam, where the exercise is accomplished by causing a lever arm to pivot. The lever arm is adjustable, and the lever arm adjustment mechanism is designed so that the variable resistance force is not affected by the starting position of the lever arm. Johns does not use an electric motor to move a weight along a pivoting arm.

U.S. Pat. No. 5,387,170, issued to R. Lee Rawls et al. on Feb. 7, 1995, shows a weight training machine wherein the user moves a weight via a pivot arm moving through a pivot arm plane. The angular orientation of the pivot arm plane is user selectable and determines the resistance force experienced by the user. Rawls et al. do not use an electric motor to move a weight along a pivoting arm.

None of the above inventions and patents, taken either singly or in combination, is seen to describe the instant invention as claimed.

SUMMARY OF THE INVENTION

The present invention is directed to a weight training machine having a dynamically controlled resistance capability. The user exercises by causing an exercise arm to pivot about an axis. The primary resistance to the pivoting of the exercise arm is provided by conventional means such as a stack of weights, springs, or elastic bands. Pivoting coaxially with the exercise arm, is a pivot arm which supports a secondary weight. Pivoting the exercise arm causes the pivot arm to pivot also. Therefore, to pivot the exercise arm not only must the primary resistance be overcome, but the torque on the pivot arm due to the secondary weight must also be overcome. By varying the distance of the secondary weight from the pivot axis, the torque due to the secondary weight—and thus the resistance experienced by the user—can be varied within a predetermined range.

Preferably an electric motor under the control of the user or an instructor is used to vary the torque due to the secondary weight, by moving the secondary weight along the length of the pivot arm. This feature allows the user or an instructor to vary the resistance dynamically during the execution of the exercise. Also, the present invention preferably includes a motion reduction mechanism, similar in operation to a speed reduction or a torque reduction mechanism, interposed between the exercise arm and the pivot arm. The purpose of the motion reduction mechanism is to reduce the angle through which the pivot arm moves as compared to the angle through which the exercise arm moves during the execution of the movement or exercise. The torque due to the secondary weight is the product of the weight of the secondary weight and the perpendicular distance between the pivot axis and a line coincident with the force exerted by gravity on the secondary weight. This perpendicular distance between the pivot axis and a line coincident with the force exerted by gravity on the secondary weight is known as the moment arm of the secondary weight, and varies with the angle of the pivot arm relative to the horizontal; the moment arm being at a maximum value when the pivot arm is horizontal, and a minimum value of zero when the pivot arm is vertical. Thus the resistance due to the torque exerted by the secondary weight varies as the pivot arm moves through its range of motion. By reducing the range of motion of the pivot arm, using the motion reduction mechanism, the resistance due to the torque exerted by the secondary weight can be more accurately controlled.

Another aspect of the invention is to provide an improved interface with the user particularly suited for a leg curling machine. Current leg curling machines have a pair of padded bars fixed to the exercise arm so as to form a "T" configuration. The user hooks the backs of their ankles under the padded bars and bends their knees to bring their heels towards their buttocks to perform the leg curl. The knee is offset from the pivot point of the exercise arm, and this causes the padded bars to ride up the user's calves, change the resistance experienced by the user, and create discomfort. It is also critical to understand the overall limitation of conventional machines. This limitation is that the user interface is an unsecured system, meaning that the ankles are not firmly bound to the exercise arm. This will always present the possibility of sliding and slippage that the present invention seeks to prevent. The mechanical user interface of the present invention is movable relative to the exercise arm so that the user interface contacts the user's body parts at substantially the same locations, on the user's body, throughout the performance of the exercise movement.

Accordingly, it is the principal object of the present invention to provide an exercise machine having dynamically controlled resistance capability.

It is a further object of the present invention to provide an exercise machine wherein the dynamically controlled resistance capability is provided by a weight movable along the length of a pivoting arm, and wherein the impetus for moving the weight is provided by an electric motor.

Still another object of the present invention is to provide an exercise machine where the resistance can be dynamically varied by either the user or an instructor.

Still another object of the present invention is to provide an exercise machine wherein the dynamically controlled resistance capability is provided by a weight movable along the length of a pivoting arm, and wherein a motion reduction mechanism is interposed between the force application means manipulated by the user and the pivoting arm.

Still another object of the present invention is to provide an exercise machine having a user interface that is more accurate in terms of the resistance experienced by the user and that does not cause discomfort to the user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
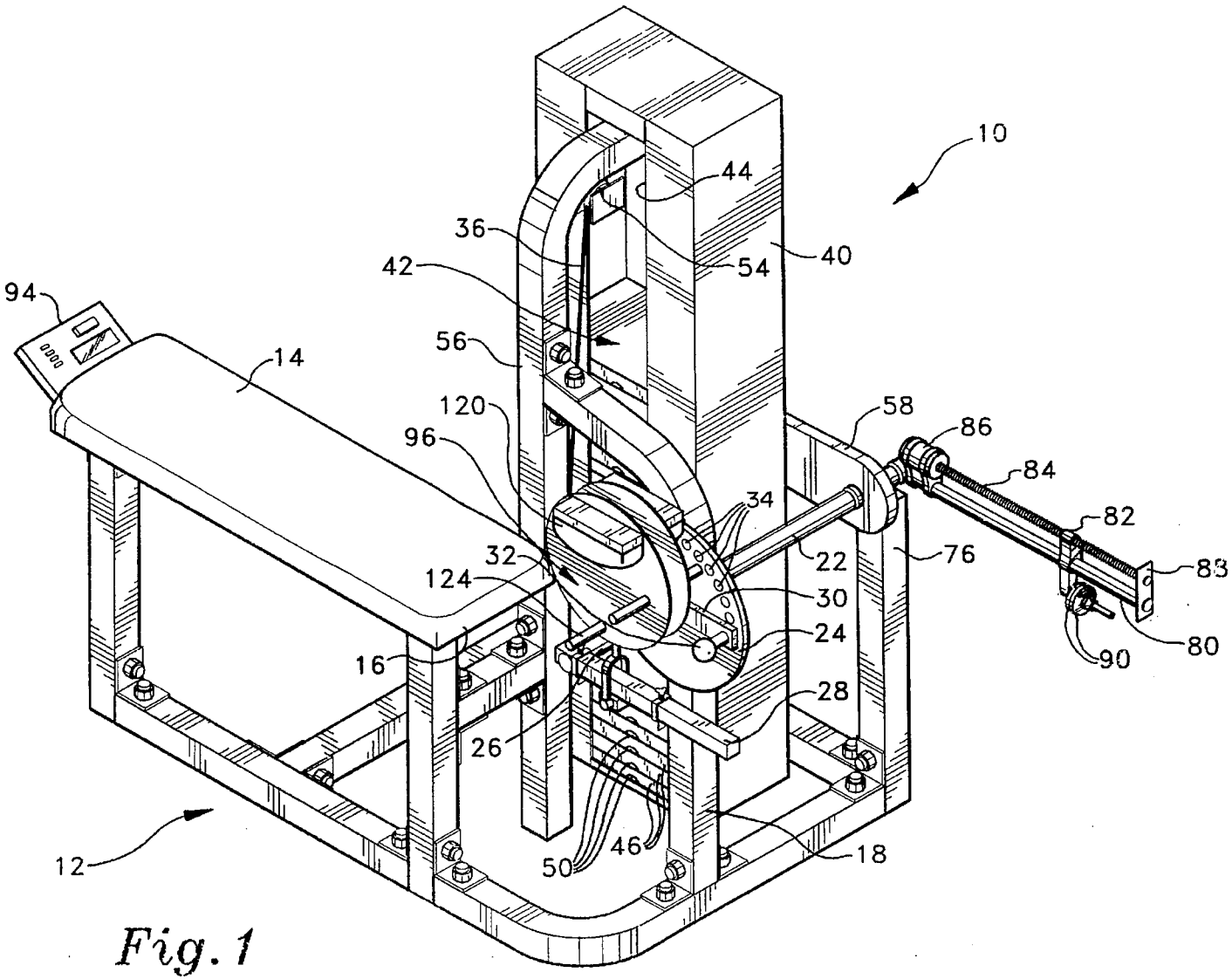
FIG. 1 is a front perspective view of the exercise machine of the present invention.

The present invention is directed to a weight training machine having a dynamically controlled resistance capability. The user exercises by causing an exercise arm to pivot about an axis. The primary resistance to the pivoting of the exercise arm is provided by conventional means such as a stack of weights, springs, or elastic bands. Pivoting coaxially with the exercise arm is a pivot arm which supports a secondary weight. Pivoting the exercise arm causes the pivot arm to pivot also. Therefore, to pivot the exercise arm not only must the primary resistance be overcome, but the torque on the pivot arm due to the secondary weight must also be overcome. By varying the distance of the secondary weight from the pivot axis, the torque due to the secondary weight—and thus the resistance experienced by the user—can be varied within a predetermined range.

Preferably an electric motor under the control of the user or an instructor is used to vary the torque due to the secondary weight by moving the secondary weight along the length of the pivot arm. This feature allows the user or an instructor to vary the resistance dynamically during the execution of the exercise. Also, the present invention preferably includes a motion reduction mechanism, similar in operation to a speed reduction or a torque reduction mechanism, interposed between the exercise arm and the pivot arm. The purpose of the motion reduction mechanism is to reduce the angle through which the pivot arm moves as compared to the angle through which the exercise arm moves during the execution of the movement or exercise. The torque due to the secondary weight is the product of the weight of the secondary weight and the perpendicular distance between the pivot axis and a line coincident with the force exerted by gravity on the secondary weight. This perpendicular distance between the pivot axis and a line coincident with the force exerted by gravity on the secondary weight is known as the moment arm of the secondary weight, and varies with the angle of the pivot arm relative to the horizontal; the moment arm being at a maximum value when the pivot arm is horizontal, and a minimum value of zero when the pivot arm is vertical. Thus the resistance due to the torque exerted by the secondary weight varies as the pivot arm moves through its range of motion. By reducing the range of motion of the pivot arm, using the motion reduction mechanism, the resistance due to the torque exerted by the secondary weight can be more accurately controlled.

Another aspect of the invention is to provide an improved interface with the user particularly suited for a leg curling machine. Current leg curling machines have a pair of padded bars fixed to the exercise arm so as to form a "T" configuration. The user hooks the backs of their ankles under the padded bars and bends their knees to bring their heels towards their buttocks to perform the leg curl. Since the knee is offset from the pivot point of the exercise arm, the padded bars tend to ride up the user's calves, thus changing the resistance experienced by the user, exerting uncomfortable pressure on the user's Achilles tendons and gastrocnemius muscles, and irritating the user's skin. The mechanical user interface of the present invention is movable relative to the exercise arm so that the user interface contacts the user's body parts at substantially the same locations, on the user's body, throughout the performance of the exercise movement.

The principles of the present invention are generally applicable to exercise machines for performing any type of exercise. However, for purposes of clarity of illustration, the present invention will be described in the context of a leg curling machine.

Referring to FIGS. 1–8, a leg curling machine incorporating the features of the present invention is seen. The leg curling machine 10 is to a large extent similar to a conventional leg curling machine. A frame 12 supports a bench 14. The bench 14 allows a user to lie thereon in the prone position with at least their lower legs extending beyond the bottom edge 16 of the bench 14. Upright frame member 18 supports a journal bearing 20 which rotatably supports a shaft 22. Fixed to the shaft 22, and rotatable therewith, is a cam 24. Shaft 22 projects for at least some distance from the face of cam 24 which is opposite the face adjacent to the bearing 20. A hollow cylindrical shaft 26 is rotatably supported by the length of shaft 22 which projects from the face of cam 24 opposite the face adjacent to the bearing 20. Fixed to shaft 26 is an exercise arm 28. Also fixed to shaft 26, at the end opposite the end to which the exercise arm 28 is fixed, is a bar 30. The bar 30 supports a spring loaded pin that is moved by knob 32. The cam 24 has a series of holes 34 therein. The angle of the exercise arm at the start of the exercise can be set by pulling knob 32 to disengage the spring loaded pin (not shown because it is conventional) from cam 24. This operation allows the exercise arm 28 to pivot freely. The exercise arm is then rotated to bring the spring loaded pin, the position of which is indicated by knob 32, into registry with a selected one of the holes 34. Now releasing the knob 32 allows the spring loaded pin to engage the selected hole 34, thus setting the angle of the exercise arm 28 at the start of the exercise.

It should be readily apparent that with the spring loaded pin engaged to one of the holes 34, pivoting the exercise arm will cause rotation of the cam 24 through the same angle as the angle through which the exercise arm 28 pivots. A cable 36 is pinned to the cam 24 at a first end and partially wraps around the cam 24. The cable 36 is supported in a groove 38 formed in the surface following the perimeter of cam 24.

The other end of cable 36 is fixed to an elongated shaft 37. The shaft 37 is located inside a housing 40. The housing 40 also houses a stack of weights 42 which provide the primary resistance mentioned previously. The housing 40 has two elongated openings 44 on either side thereof. The openings 44 provide access to the stack of weights 42. The stack of weights 42 is made up of a plurality of rectangular cast iron plates 46. Each plate 46 has a central opening 39 extending through the entire thickness of the plate. When the plates are stacked together, the central openings 39 of the plates register with one another forming an elongated channel down the center of the stack 42 into which the shaft 37 fits. Shaft 37 has a plurality of holes 48 which register with respective channels 50 formed in the underside of each plate 46. A pin 52 is inserted through a channel 50 and into a respective hole 48 to select the magnitude of the primary resistance to be overcome during the exercise.

The cable 36 is routed around pulleys, including pulley 54, to direct cable 36, as it comes up from cam 24, down toward the stack 42. Upright frame member 56 vertically supports pulley 54. As was mentioned previously, pivoting the exercise arm will cause rotation of the cam 24 when the spring loaded pin attached to knob 32 is engaged to one of the holes 34. As the cam 24 rotates counter clockwise, as viewed from the exercise arm side of cam 24, more of the cable 36 is taken up by cam 24 causing the lifting of the shaft 37 and consequently of the plates above the pin 52. It is the weight of the plates 46 above the pin 52 which supplies the primary resistance to the exercise movement.

The end of shaft 22 distal from the cam 24 is rotatably supported by a housing 58 which houses the motion reduction mechanism. The motion reduction mechanism includes a sprocket 60, chain 62, sprocket 64, shaft 66, sprocket 68, chain 70, and sprocket 72. Sprocket 60 is fixed to and rotates with shaft 22. Shaft 66 is rotatably supported by housing 58. Sprockets 64 and 68 are fixed to and rotate with shaft 66. Sprockets 60, 64, and 68 are of the same size. Sprocket 72 is larger than the other three sprockets. An output shaft 74 is journaled to the housing 58 and to the upright frame member 76. Sprocket 72 is fixed to and rotates with shaft 74. Chain 62 links sprocket 60 with sprocket 64 such that the two rotate together. Sprockets 64 and 68 being linked by shaft 66, sprocket 68 also mimics the rotational motion of sprocket 60. Chain 70 causes sprocket 72 to rotate as a result of the rotation of sprocket 68. In the illustrated example, sprocket 72 is twice the diameter of the other sprockets, therefore sprocket 72 will rotate half as much as the other sprockets.

The ratio of the size of sprocket 72 to the other sprockets can of course be varied within a wide range, and the illustrated ratio is not intended to be limiting in any way. Shaft 74 being fixed to the sprocket 72, it should be apparent that the shaft 74 rotates half as much as shaft 22. Upright frame member 76 also acts to support housing 58 in cooperation with upright frame member 78.

Figure 6:
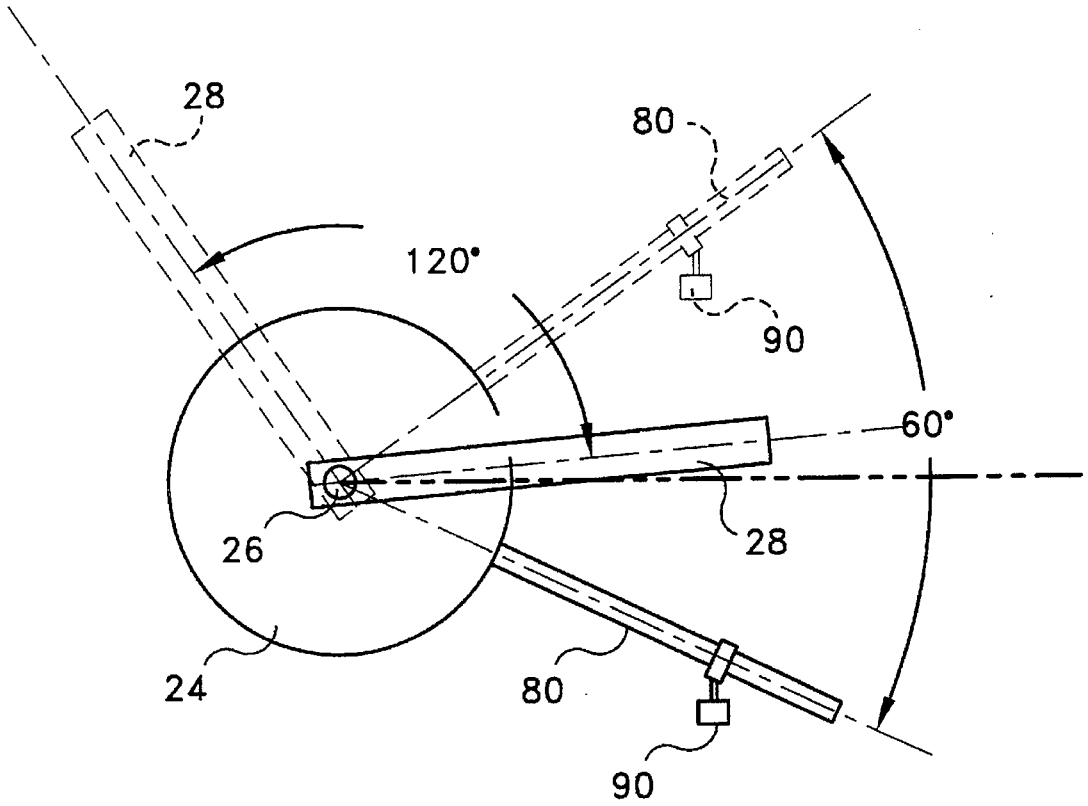
FIG. 6 is a fragmentary side view showing the relative ranges of motion of the exercise arm and the pivot arm, and with the secondary weight positioned far from the pivot axis of the pivot arm.
Figure 7:
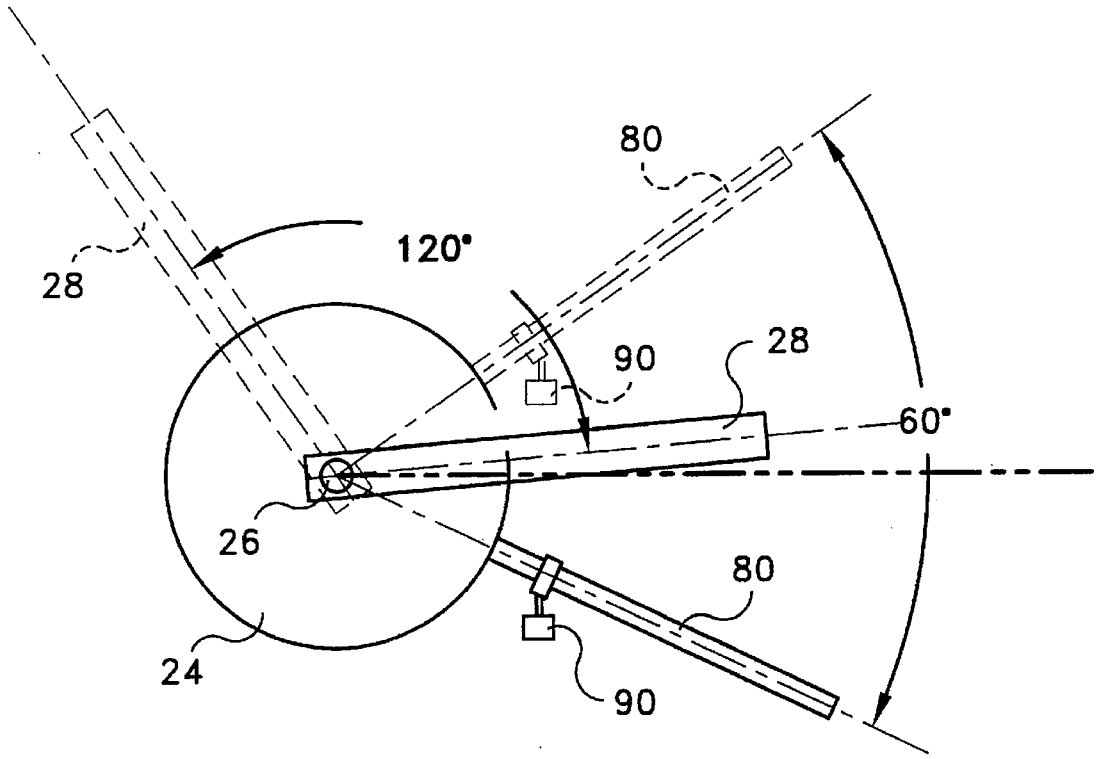
FIG. 7 is a fragmentary side view showing the relative ranges of motion of the exercise arm and the pivot arm, and with the secondary weight positioned near the pivot axis of the pivot arm.
Figure 8:
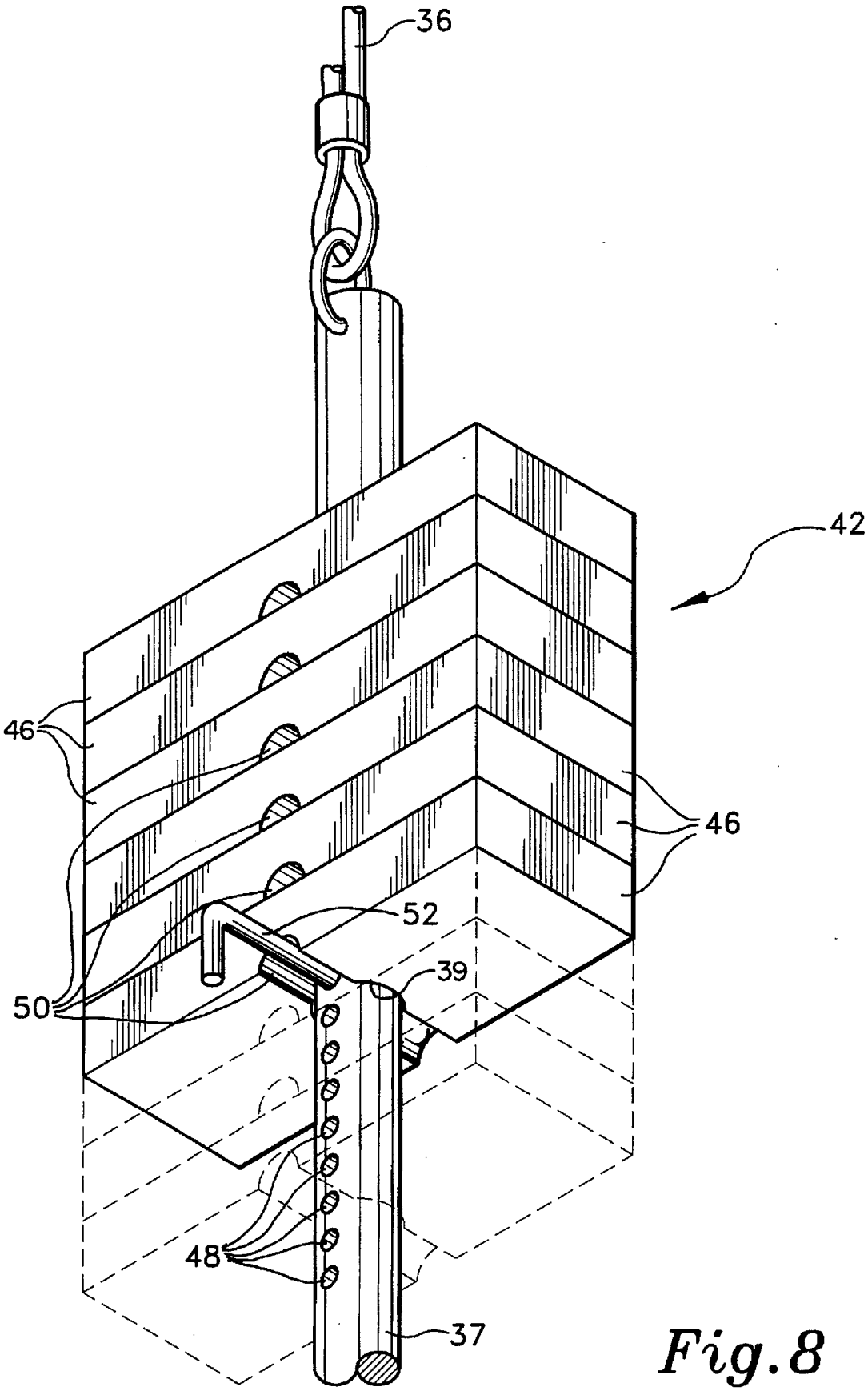
FIG. 8 is a fragmentary view showing the manner of engagement of the stack of weights with the pulling cable of the present invention.

Perpendicularly fixed to shaft 74 is a pivot arm 80. Pivot arm 80 pivots about the longitudinal axis of shaft 74, which is coincident with the longitudinal axis of shaft 22. The pivot arm 80 being fixed to shaft 74, the pivot arm 80 pivots through the same angle as the angle through which the shaft 74 rotates. Further, since shaft 74 rotates half as much as shaft 22, the pivot arm 80 pivots through an angle which is half the angle through which the exercise arm 28 pivots. Referring to FIGS. 6 and 7, it can be seen that a 120° rotation of exercise arm 28 results in a 60° rotation of pivot arm 80.

It should be borne in mind that the illustrated motion reduction mechanism is only an example. Other mechanisms using planetary gears, wheel gears, and pulleys for example, can also be used to achieve the same result without departing from the spirit and scope of the present invention.

Slidably supported by pivot arm 80, is a collar 82. Collar 82 has a first bore which slidably engages pivot arm 80 and a second, threaded bore which matingly engages screw 84. Screw 84 is positioned parallel to pivot arm 80 and runs along substantially the entire length of the pivot arm 80. Supported by the end of the pivot arm 80 which is proximate the shaft 74, is an electric motor 86. The end of screw 84, proximate the shaft 74, operably engages the motor 86. The end of screw 84, distal from the shaft 74, is rotatably supported by bracket 88 which is in turn fixed to the pivot arm 80. The motor 86 acts to rotate the screw 84 about its own longitudinal axis. Rotation of the screw 84 causes the collar 82 to move along the length of the pivot arm 80. A secondary weight, in the illustrated examples being formed by one or more plates 90, is attached to the collar 82. The terms weights and plates are used interchangeably herein to refer to item 90. The collar 82 has an extension to which a bar 83 is attached. Bar 83 in turn supports the weights 90. The weights 90 are secured in place by the collar 85. Collar 85 is releasably securable to the bar 83 by a screw 87, allowing the amount of the secondary weight to be varied by changing the number of plates 90. The torque on shaft 22 resulting from the torque exerted on shaft 74 by weights 90 creates an additional resistance that must be overcome by the user during exercise. The magnitude of this additional resistance depends on the position of collar 82 on pivot arm 80. The position of collar 82 on pivot arm 80, and thus the magnitude of the additional resistance can be varied by running the motor 86 in either the forward or the reverse direction.

Power is supplied to motor 86 by cable 92. Current flow through cable 92 is controlled through the use of control panel 94. Control panel 94 must be capable of supplying current in a first direction, supplying current in a reverse direction, and interrupting current altogether. These functions can be accomplished by well known means. The position of the control panel 94 on bench 14, allows the user to vary the position of collar 82 during exercise. Also the control panel 94 may be made removable and provided with a longer electrical cable 92 to allow an instructor to control the resistance due to the secondary weights 90. Power would ordinarily be supplied to the control panel 94 from a wall socket by a prong type plug (not shown). Again many alternative methods of moving weights 90 may be employed without departing from the spirit and scope of the present invention. For example, the motor could be mounted transversely to the pivot arm 80 and move the weights 90 via a rack and pinion arrangement.

Figure 2:
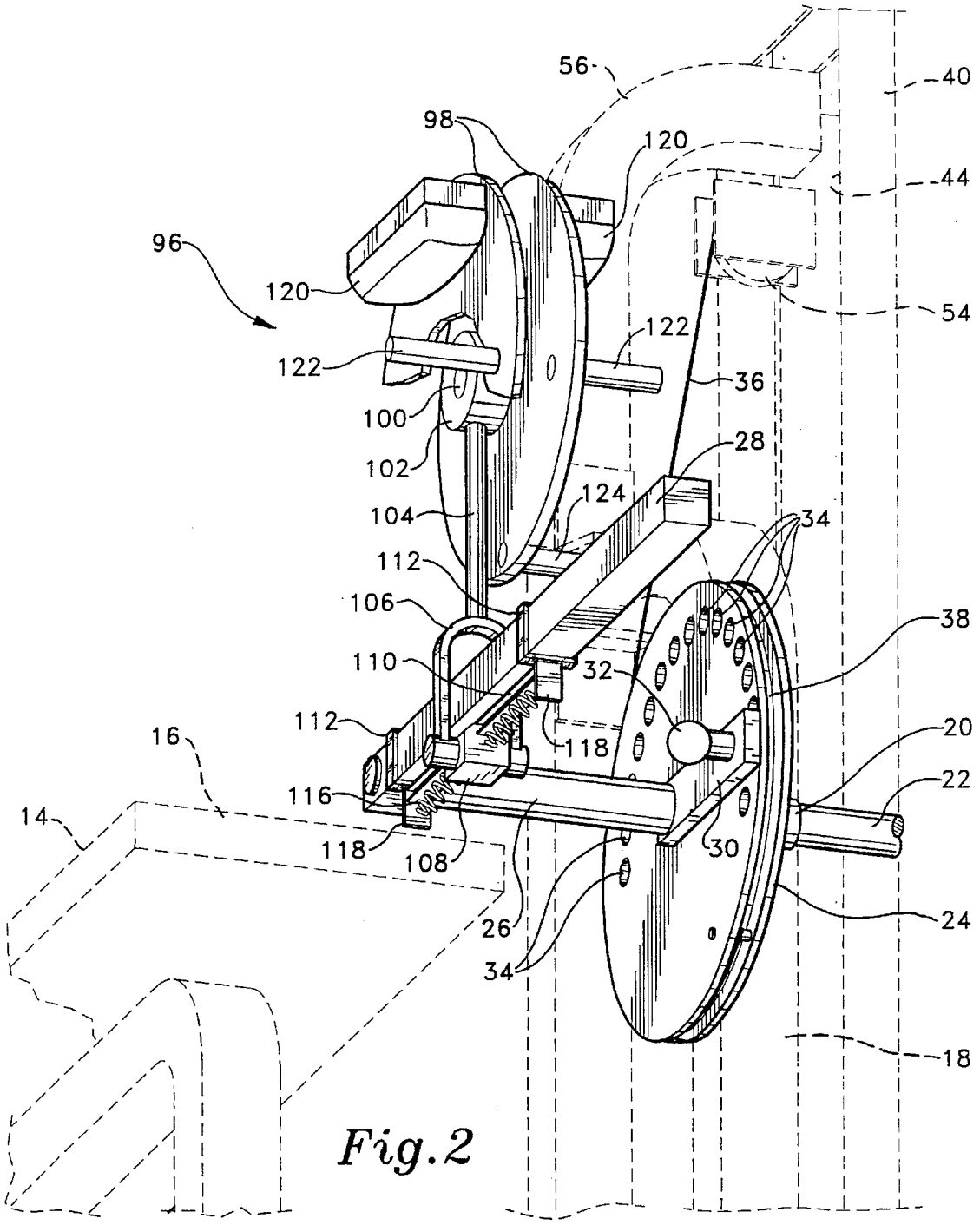
FIG. 2 is a fragmentary view showing the user interface, or the force application means manipulated by the user during performance of the exercise, in accordance with the present invention.
Figure 3:
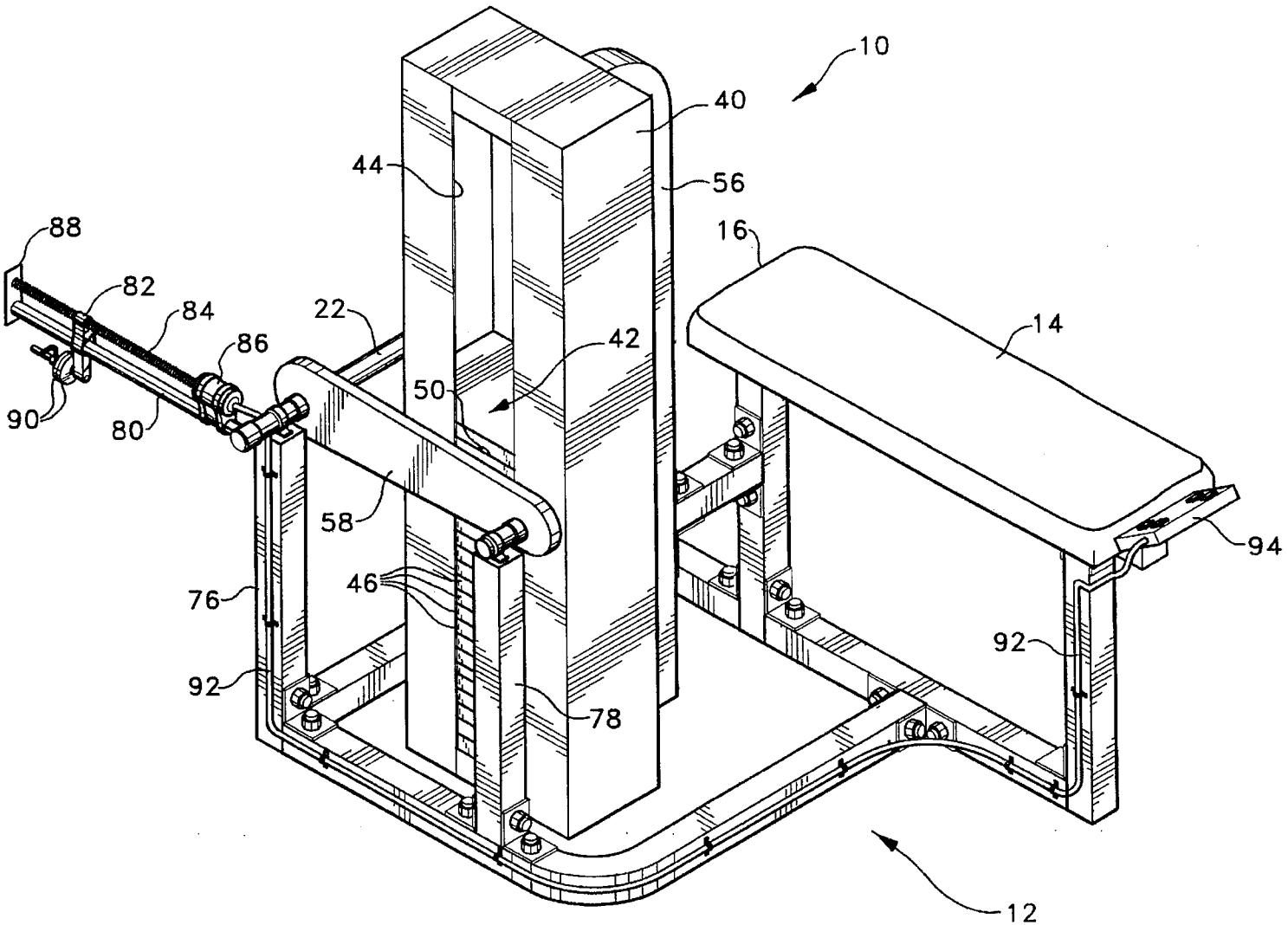
FIG. 3 is a rear perspective view of the exercise machine of the present invention.
Figure 4:
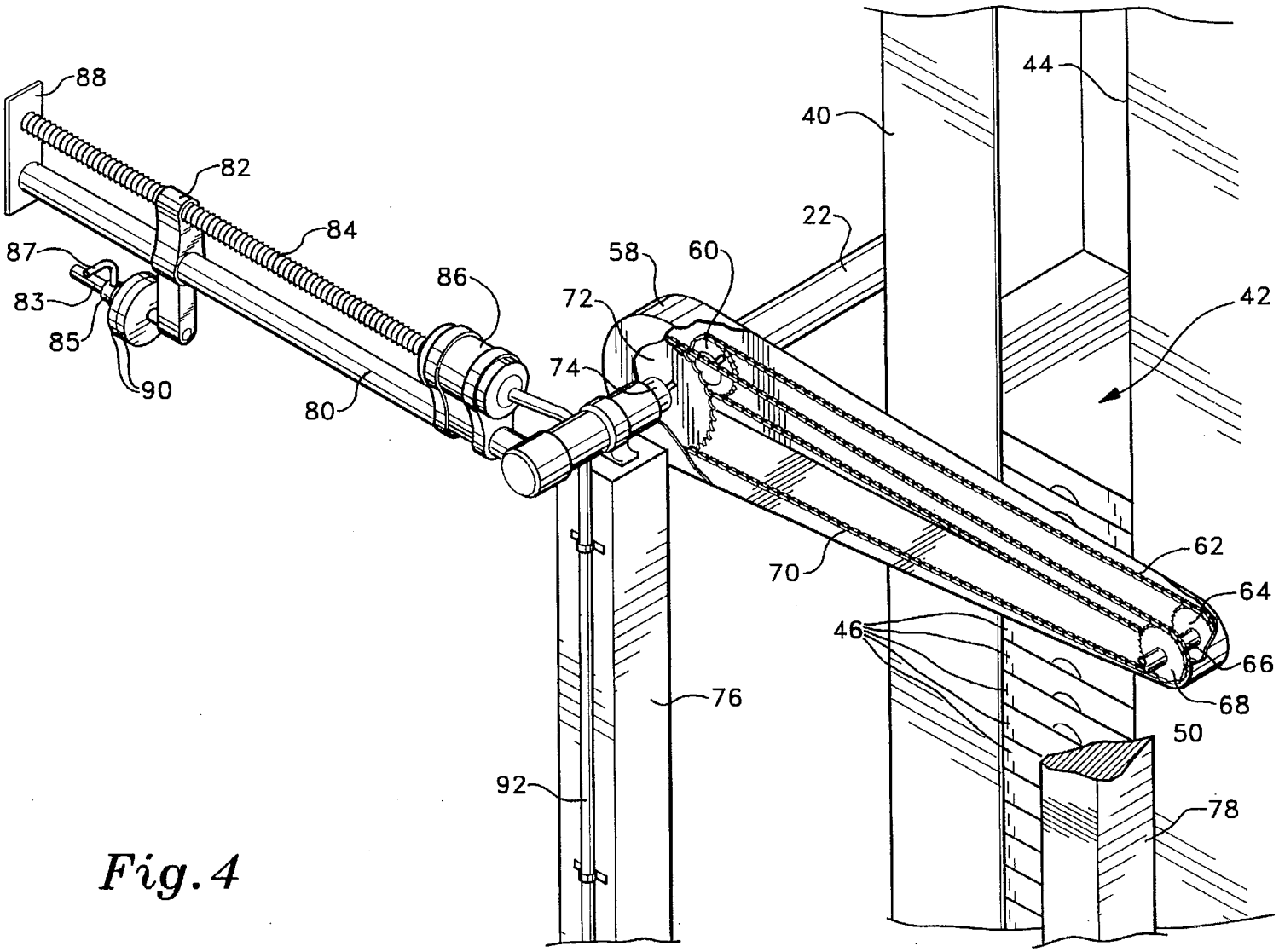
FIG. 4 is a fragmentary view showing the motion reduction mechanism of the present invention partially broken away to reveal internal detail.
Figure 5:
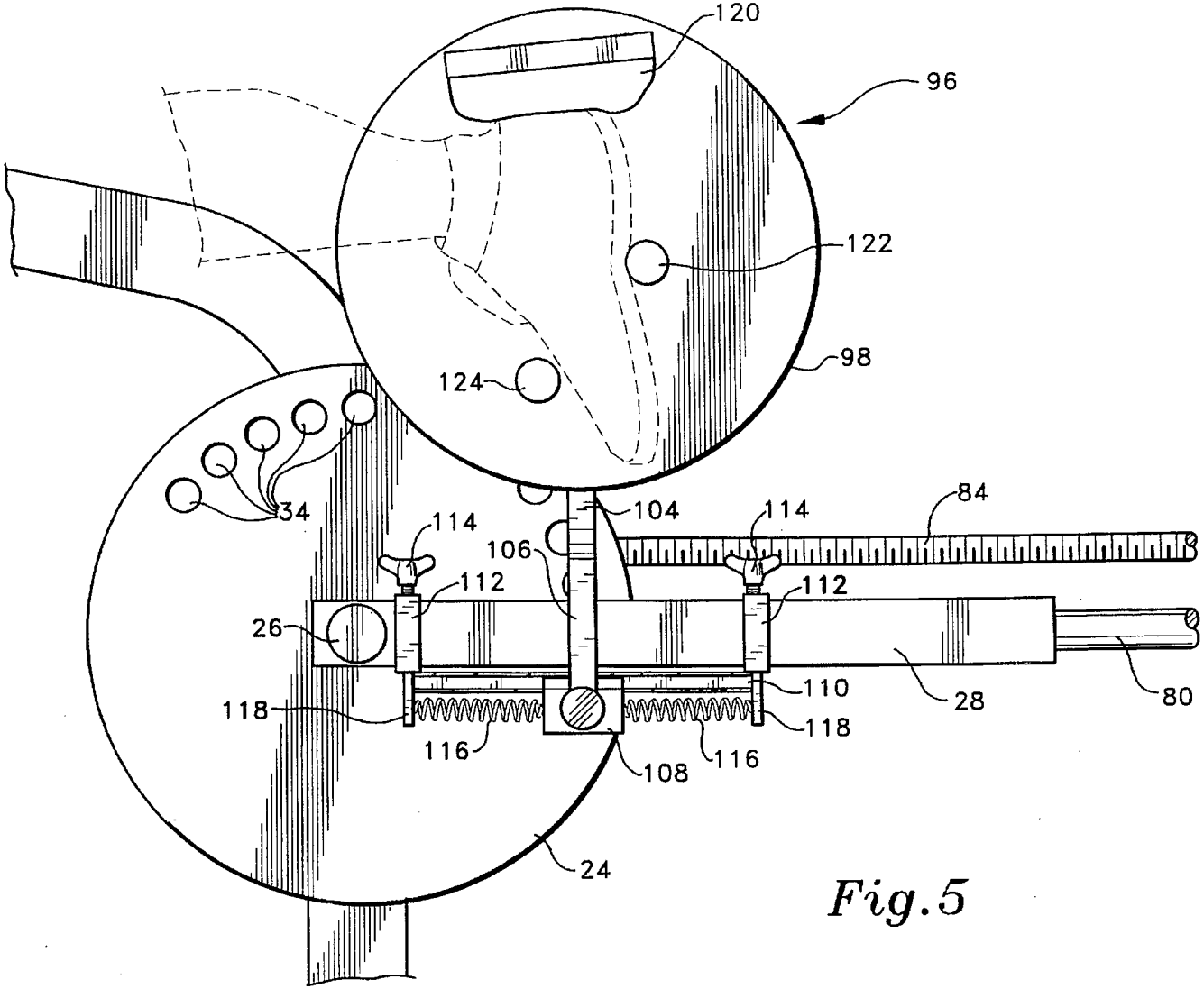
FIG. 5 is a fragmentary side view showing the mechanical user interface of the present invention.

Referring to FIGS. 2 and 5 in particular, the mechanical user interface 96 which is engaged by a users's body part, and transmits the force applied by the user to the exercise arm 28, can be seen. The mechanical user interface 96 includes two disks 98 connected at the center by a wrist pin 100. The wrist pin 100 is rotatably supported by the big end 102 of the connecting rod 104. The connecting rod 104 also has a bifurcated end 106 which straddles the exercise arm 28. The bifurcated end 106 is rotatably supported by a slide 108. The slide 108 freely slides on a track 110. Track 110 is rigidly fixed between two sliding collars 112 that are supported by the exercise arm 28. The position of the collars 112 and track 110, on exercise arm 28, can be adjusted by sliding the collars 112 and track 110 as a unit along the length of the exercise arm 28. Once in the desired position the collars 112 and track 110 are secured in place by thumb screws 114. The slide 108 is biased toward the center of the track 110 by springs 116 positioned on either side of the slide 108 and extending between the slide 108 and a respective extension 118. Each extension 118 is fixedly attached to a respective sliding collar 112.

On the outer lateral surfaces of the disks 96 are projections that are engageable by the user's lower legs. These projections include two cushioned pads 120, foot pegs 122, and foot pegs 124. The user's feet engage the interface 96 in the manner shown in FIG. 5. The bottoms of the user's feet rest on pegs 122, while the foot pegs 124 abut against the tops of the user's feet. The cushioned pads 120 abut the back of the lower legs of the user, either at the back of the heel or at the back of the leg just above the ankle. It is the cushioned pads 120 against which the user applies force while exercising.

As with conventional leg curling machines, the user lies prone on the bench 14 with at least their lower legs extending beyond the bottom edge 16. The user then engages the lower legs and feet to the user interface 96 substantially as shown in FIG. 5. The user can now perform the exercise by bending the legs at the knees to bring the heels towards their buttocks. Because in the present invention the structures that contact the user's body part remain stationary relative to the user's body part throughout the exercise movement, the discomfort associated with prior art exercise machines is reduced.

Figure 9:
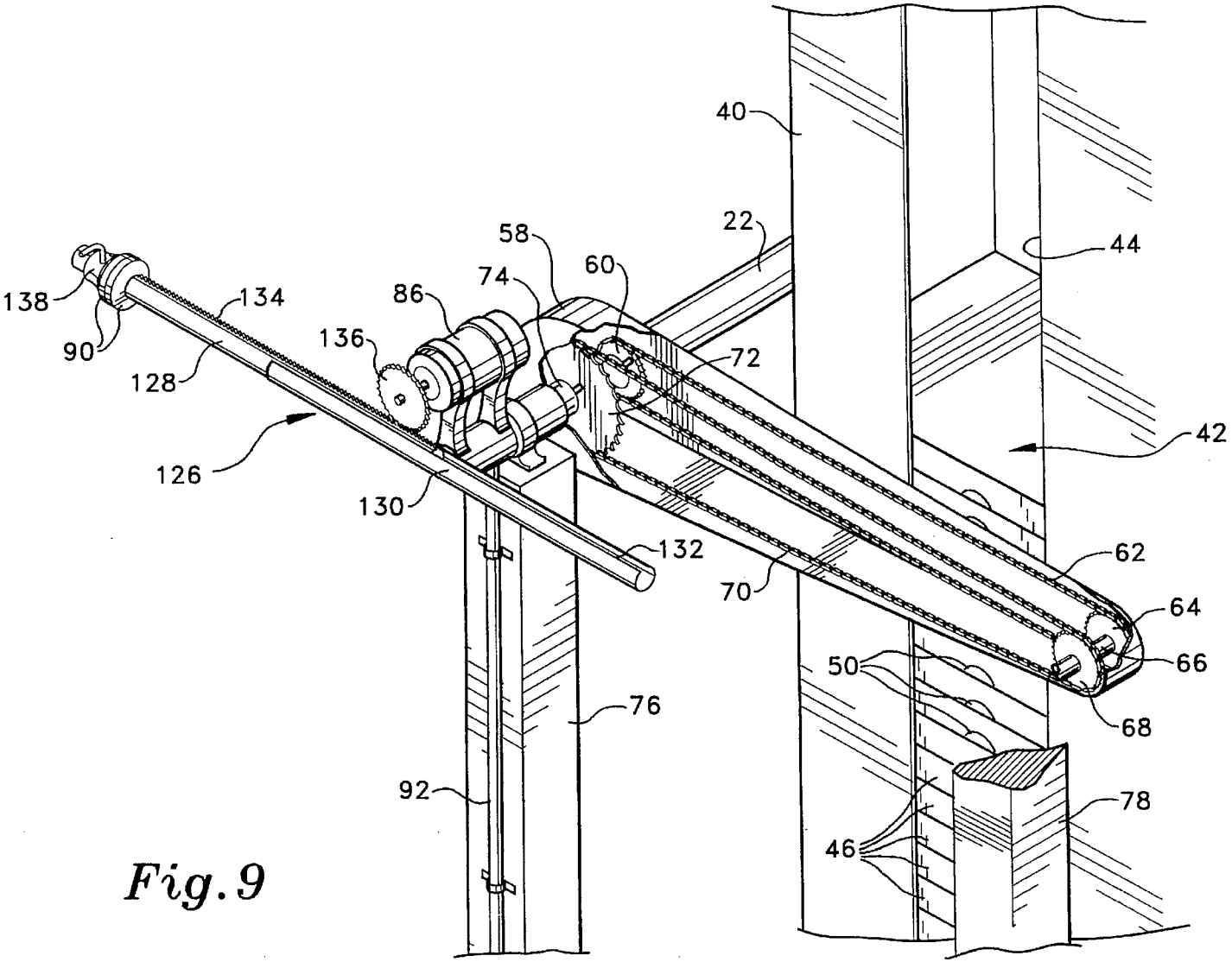
FIG. 9 is a fragmentary view showing an alternative embodiment of the present invention having a telescoping pivot arm.

Referring to FIG. 9, an alternative embodiment of the present invention can be seen. This embodiment differs from the embodiment of FIGS. 1–8 in that the pivot arm 80 is replaced by a telescoping pivot arm 126. Pivot arm 126 includes a bar 128 that is slidably supported in a sleeve 130. The sleeve 130 is fixed to the end of the shaft 74. The sleeve 130 is C-shaped in cross-section having an elongated opening 132 extending along substantially the entire length thereof. The opening 132 allows the toothed rack 134 to be accessible through the sleeve 130 as the bar 128 slides within the sleeve 130. The rack 134 projects from the bar 128 and extends along substantially the entire length of the bar 128. In this case, the motor 86 is fixed to the shaft 74 and turns a pinion gear 136. The weights 90 are directly supported at the end of the bar 128. The pinion gear 136 is in engagement with the rack 134 so that rotation of pinion gear 136, by motor 86, moves bar 128 in or out of sleeve 130 changing the moment due to the weights 90. As before, a collar 138 allows the amount of the weights 90 to be adjusted.

Figure 10:
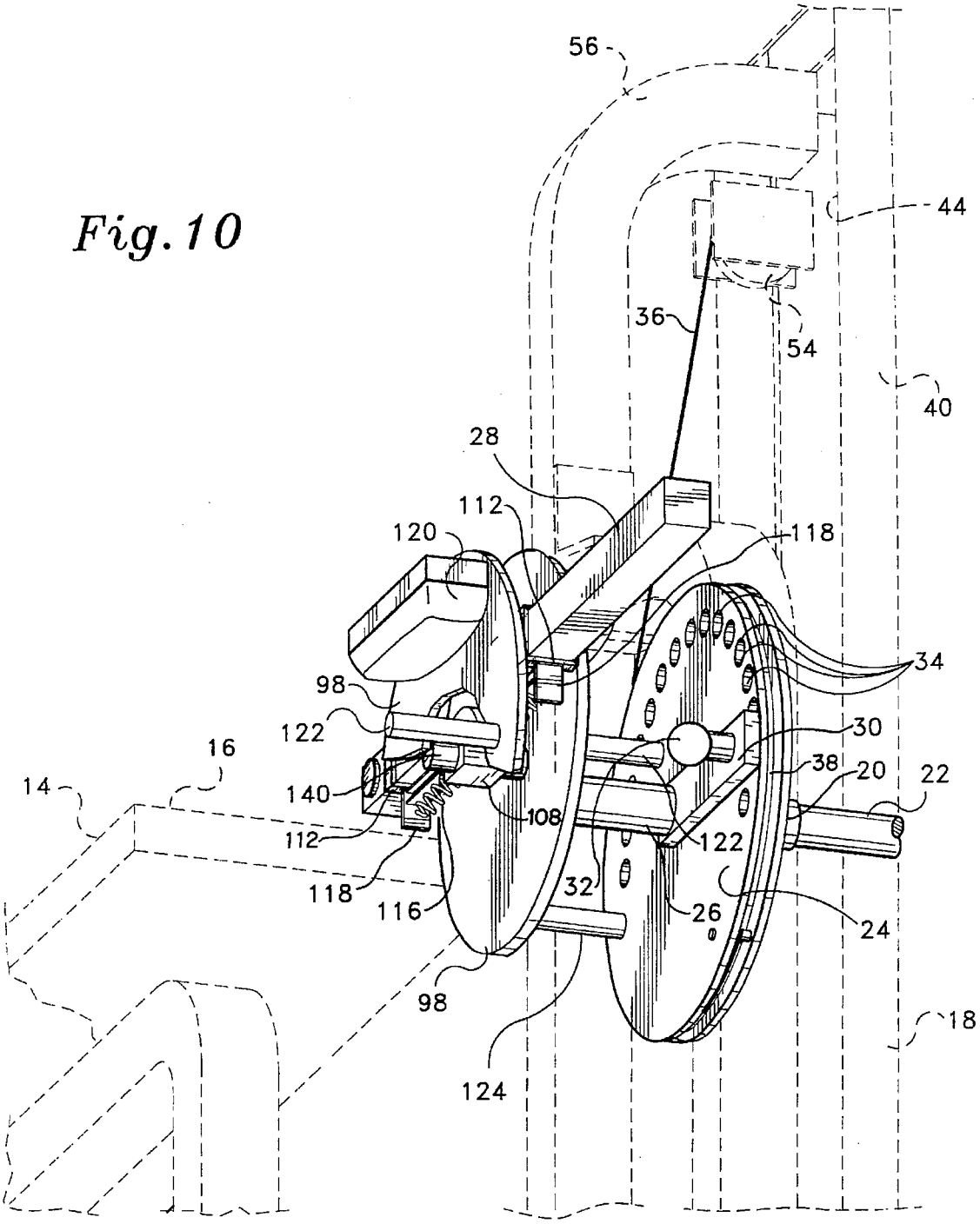
FIG. 10 is a fragmentary view showing an alternative embodiment of the present invention wherein the foot engaging disks are directly attached to the spring biased slide.

Referring to FIG. 10, another alternative is shown. The only difference between the embodiment of FIG. 10 and that of FIGS. 1–8 is that the connecting rod 104 is eliminated in the embodiment of FIG. 10, and the two disks 98 are rotatably supported by the pin 140 which is in turn directly supported by the slide 108.

It is to be understood that the present invention is not limited to the embodiments described above, but encompasses any and all embodiments within the scope of the following claims.

I claim:

1. An exercise machine comprising:

an exercise arm, a user using said exercise machine to perform an exercise by causing said exercise arm to pivot about an axis;

a pivot arm mechanically linked to said exercise arm, said pivot arm pivoting about said axis responsive to pivoting movement of said exercise arm;

a weight mechanically linked to said pivot arm, said weight having a gravitational force thereon, said weight being shiftable to a user selectable distance from said axis, said gravitational force generating a torque about said axis, said torque having a magnitude dependent at least in part on said user selectable distance, whereby said torque is user selectable and said torque provides at least in part a resistance which must be overcome by the user in order to perform the exercise; and an interface engageable with a body part of the user for transmitting force exerted by the body part of the user to said exercise arm, said interface including:

first and second collars being dimensioned and configured to be slidably supportable by the exercise arm, said first and second collars each having a thumb screw for securing said first and second collars to the exercise arm;

a track fixed between said first and second collars and being movable therewith, said track having a middle;

a slide slidably supported on said track, said slide being biased toward about said middle of said track by a pair of springs provided on either side of said slide, each of said pair of springs extending between said slide and a respective one of said first and second collars, said slide adapted to being positioned under the exercise arm when said interface is mounted to the exercise arm; and a pair of disks rotatably supported by said slide, each of said pair of disks having a face adjacent said slide and a face distal from said slide, and each said face of said pair of disks distal from said slide having a cushioned pad, a first peg, and a second peg being engageable by the body part of the user.

2. The exercise machine according to claim 1, including an electric motor for shifting said weight to said user selectable distance.

3. The exercise machine according to claim 2, wherein a motion reduction mechanism is provided as part of a mechanical link between said pivot arm and said exercise arm, said motion reduction mechanism allowing said pivot arm to pivot through a first angle in response to said exercise arm being pivoted through a second angle, and said first angle being smaller than said second angle.

4. The exercise machine according to claim 2, wherein said weight is shifted by changing the length of said pivot arm.

5. The exercise machine according to claim 4, wherein a motion reduction mechanism is provided as part of a mechanical link between said pivot arm and said exercise arm, said motion reduction mechanism allowing said pivot arm to pivot through a first angle in response to said exercise arm being pivoted through a second angle, and said first angle being smaller than said second angle.

6. The exercise machine according to claim 1, wherein a motion reduction mechanism is provided as part of a mechanical link between said pivot arm and said exercise arm, said motion reduction mechanism allowing said pivot arm to pivot through a first angle in response to said exercise arm being pivoted through a second angle, and said first angle being smaller than said second angle.

7. The exercise machine according to claim 1, further including in said interface a connecting rod having a bifurcated end and an enlarged end, said bifurcated end being rotatably supported by said slide, said bifurcated end straddling the exercise arm to thereby allow said enlarged end to be positioned above the exercise arm when said interface is mounted to the exercise arm; and said pair of disks rotatably supported by said enlarged end, each of said pair of disks having a face adjacent said enlarged end and a face distal from said enlarged end.

8. The exercise machine according to claim 7, wherein a motion reduction mechanism is provided as part of a mechanical link between said pivot arm and said exercise arm, said motion reduction mechanism allowing said pivot arm to pivot through a first angle in response to said exercise arm being pivoted through a second angle, and said first angle being smaller than said second angle.

9. The exercise machine according to claim 7, including an electric motor for shifting said weight to the selectable distance.

10. The exercise machine according to claim 9, wherein a motion reduction mechanism is provided as part of a mechanical link between said pivot arm and said exercise arm, said motion reduction mechanism allowing said pivot arm to pivot through a first angle in response to said exercise arm being pivoted through a second angle, and said first angle being smaller than said second angle.

11. The exercise machine according to claim 7, including an electric motor for shifting said weight to the user selectable distance, and said weight is shifted by changing the length of said pivot arm.

12. The exercise machine according to claim 11, wherein a motion reduction mechanism is provided as part of a mechanical link between said pivot arm and said exercise arm, said motion reduction mechanism allowing said pivot arm to pivot through a first angle in response to said exercise arm being pivoted through a second angle, and said first angle being smaller than said second angle.

13. An interface engageable with a body part of a user for transmitting force exerted by the body part of the user to an exercise arm of an exercise machine, said interface comprising:

first and second collars being dimensioned and configured to be slidably supportable by the exercise arm, said first and second collars each having a thumb screw for securing said first and second collars to the exercise arm;

a track fixed between said first and second collars and being movable therewith, said track having a middle;

a slide slidably supported on said track, said slide being biased toward about said middle of said track by a pair of springs provided on either side of said slide, each of said pair of springs extending between said slide and a respective one of said first and second collars, said slide adapted to being positioned under the exercise arm when said interface is mounted to the exercise arm;

a connecting rod having a bifurcated end and an enlarged end, said bifurcated end being rotatably supported by said slide, said bifurcated end straddling the exercise arm to thereby allow said enlarged end to be positioned above the exercise arm when said interface is mounted to the exercise arm; and a pair of disks rotatably supported by said enlarged end, each of said pair of disks having a face adjacent said enlarged end and a face distal from said enlarged end, and each said face of said pair of disks distal from said enlarged end having a cushioned pad, a first peg, and a second peg engageable by the body part of the user.

14. An interface engageable with a body part of a user for transmitting force exerted by the body part of the user to an exercise arm of an exercise machine, side interface comprising:

first and second collars being dimensioned and configured to be slidably supportable by the exercise arm, said first and second collars each having a thumb screw for securing said first and second collars to the exercise arm;

a track fixed between said first and second collars and being movable therewith, said track having a middle;

a slide slidably supported on said track, said slide being biased toward about said middle of said track by a pair of springs provided on either side of said slide, each of said pair of springs extending between said slide and a respective one of said first and second collars, said slide adapted to being positioned under the exercise arm when said interface is mounted to the exercise arm; and a pair of disks rotatably supported by said slide, each of said pair of disks having a face adjacent said slide and a face distal from said slide, and each said face of said pair of disks distal from said slide having a cushioned pad, a first peg, and a second peg being engageable by the body part of the user.

* * * * *